US008865057B2

(12) United States Patent
Li et al.

(10) Patent No.: US 8,865,057 B2
(45) Date of Patent: Oct. 21, 2014

(54) APPARATUS AND METHODS FOR INDUSTRIAL-SCALE PRODUCTION OF METAL MATRIX NANOCOMPOSITES

(75) Inventors: Xiaochun Li, Madison, WI (US); Noe Gaudencio Alba-Baena, El Paso, TX (US); Daniel Earl Hoefert, Manitowoc, WI (US); David Weiss, Manitowoc, WI (US); Woo-hyun Cho, Madison, WI (US); Ben Peter Slater, Madison, WI (US); Hongseok Choi, Madison, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 335 days.

(21) Appl. No.: 13/366,655

(22) Filed: Feb. 6, 2012

(65) Prior Publication Data

US 2013/0199339 A1 Aug. 8, 2013

(51) Int. Cl.

| | |
|---|---|
| ***C22B 9/00*** | (2006.01) |
| ***C22B 3/00*** | (2006.01) |
| ***C22B 9/10*** | (2006.01) |
| ***B01F 3/12*** | (2006.01) |

(52) U.S. Cl.

CPC ..... *C22B 9/103* (2013.01); *B01F 3/1221* (2013.01)

USPC ..... 266/80; 266/90; 266/216; 266/235; 366/182.1; 366/282; 366/327.4; 164/57.1; 148/538

(58) Field of Classification Search

CPC ..... C22B 9/103; B01F 3/1221; B01F 3/1213; B01F 15/00136

USPC ..... 266/80, 90, 216, 235; 977/900; 366/182.1, 292, 327.4

See application file for complete search history.

(56) References Cited

U.S. PATENT DOCUMENTS 5,366,207 A * 11/1994 Lin ..... 266/216
6,547,850 B1 * 4/2003 Skibo et al. ..... 75/708

OTHER PUBLICATIONS

Calik et al., Mechanical Properties of Boronized AISI 316, AISI 1040, AISI 1045 and AISI 4140 Steels, Acta Physica Polonica A, vol. 115, No. 3, 2009, pp. 694-698.

Eskin et al., Production of natural and synthesized aluminum-based composite materials with the aid of ultrasonic (cavitation) treatment of the melt, Ultrasonics Sonochemistry, vol. 10, Jul. 2003, pp. 297-301.

Fan et al., Semi-solid processing of engineering alloys by a twin-screw rheomoulding process, Materials Science and Engineering: A, vol. 299, Feb. 15, 2001, pp. 210-217.

Yan et al., Review Durability of materials in molten aluminum alloys, Journal of Materials Science, vol. 36, 2001, pp. 285-295.

Freudig et al., Dispersion of powders in liquids in a stirred vessel, Chemical Engineering and Processing, vol. 38, Sep. 1999, pp. 525-532.

(Continued)

*Primary Examiner* — George Wyszomierski
*Assistant Examiner* — Tima M McGuthry Banks
(74) *Attorney, Agent, or Firm* — Bell & Manning, LLC

(57) ABSTRACT

Apparatus and methods for industrial-scale production of metal matrix nanocomposites (MMNCs) are provided. The apparatus and methods can be used for the batch production of an MMNC in a volume of molten metal housed within the cavity of a production chamber. Within the volume of molten metal, a flow is created which continuously carries agglomerates of nanoparticles, which have been introduced into the molten metal, through a cavitation zone formed in a cavitation cell housed within the production chamber.

10 Claims, 9 Drawing Sheets

(56) References Cited

OTHER PUBLICATIONS

Tiryakioglu et al., On the ductility potential of cast Al-Cu-Mg (206) alloys, Materials Science and Engineering A, vol. 506, Apr. 25, 2009, pp. 23-26.

Zheng et al., Assessment of Thermodynamic Stability of Reinforcements in Aluminum Alloy Melts, High-temperature materials and processes, vol. 22, No. 1, Feb. 2003, pp. 35-45.

Choi et al., Characterization of hot extruded Mg/SiC nanocomposites fabricated by casting, J. Mater. Sci, vol. 46, Jan. 6, 2011, pp. 2991-2997.

* cited by examiner

APPARATUS AND METHODS FOR INDUSTRIAL-SCALE PRODUCTION OF METAL MATRIX NANOCOMPOSITES

REFERENCE TO GOVERNMENT RIGHTS

The invention was made with government support under 70NANB 10H003 awarded by National Institute of Standards and Technology. The government has certain rights in the invention.

BACKGROUND

A nanocomposite includes a matrix material and nanoparticles which have been added to the matrix material to improve a particular property of the material. For example, nanoparticles can be added to materials to keep them lightweight and make them ductile, while simultaneously increasing the strength of the materials. Nanocomposites having high strength-to-weight ratios are of interest to industries, such as the aerospace and automotive industries, provided they can be produced at lower cost with properties comparable to more conventional, heavier materials.

Metal matrix nanocomposites (MMNCs) are a type of nanocomposite in which nanoparticles, such as ceramic nanoparticles, are added to a metal matrix. MMNCs are desirable because they can be made from relatively inexpensive, abundant metals with strengths comparable to those of more expensive alloys. Although MMNCs have the potential for use in many industrial applications, their use has been limited by restrictions in batch size and process development that have hindered the ability to produce MMNCs in industrial-scale quantities.

MMNCs have been produced at the laboratory scale (i.e., in quantities of a few hundred grams or less) using a simple set-up where an ultrasonic probe is inserted into a small crucible containing a molten metal to which nanoparticles have been added. The ultrasonic probe uses cavitation to break-up nanoparticle agglomerates into nanoparticle agglomerates and individual nanoparticles, which are then dispersed within the molten metal. Unfortunately, the quantity of MMNC that can be processed in such a system scales with the probe diameter and it is impractical to scale-up the ultrasonic probe to a size that would allow for industrial-scale production. For this reason, methods for producing MMNCs in industrial-scale quantities based on ultrasonic cavitation have not been developed.

SUMMARY

Apparatus for the production of metal matrix nanocomposites are provided. In one embodiment, an apparatus comprises a production chamber defining a cavity; a nanoparticle feeding system; a nanoparticle mixing system; a cavitation system and a pumping conduit. Components of the nanoparticle feeding system can comprise a nanoparticle source in communication with the production chamber cavity through a feeding system output port, and a nanoparticle flow rate controller configured to control the flow rate of nanoparticles from the nanoparticle source to the feeding system output port. Components of the nanoparticle mixing system can comprise a first impeller disposed within the production chamber cavity and configured to apply an axial shear force to nanoparticle agglomerates entering a molten metal held in the production chamber cavity through the feeding system output port, and to force the nanoparticle agglomerates downward into the molten metal; and a second impeller disposed within the production chamber and configured to apply a radial shear force to nanoparticle agglomerates forced downward into a molten metal held in the production chamber by the first impeller. Components of the cavitation system can comprise a cavitation cell disposed within the production chamber cavity and defining a cavitation cavity having an input aperture and an output aperture, wherein the cavitation cell is positioned within the production chamber cavity such that a sub-volume of molten metal held within the cavitation cavity could flow out through the output aperture and back into a larger volume of molten metal held in the production chamber cavity, and a cavitation source configured to create a cavitation zone within a molten metal held in the cavitation cavity.

The pumping conduit can be configured to conduct a flow of molten metal held in the production chamber cavity from the second impeller into the cavitation cavity through the cavitation cavity input aperture.

An example of a nanoparticle flow rate controller is an auger assembly comprising an auger housing that defines an opening in communication with the nanoparticle source and an auger blade received within the auger housing and configured to transport nanoparticles from the nanoparticle source to the feeding system output port when the auger blade is rotated. An example of a cavitation source is an ultrasonic probe.

In some embodiments of the apparatus, the cavitation cavity input aperture is centered directly below the cavitation source in the cavitation cavity and the cavitation cavity output aperture is disposed opposite the cavitation cavity input aperture. In such embodiments, the cavitation source can extend into the cavitation cavity through the cavitation cavity output aperture.

In some embodiments, the pumping conduit comprises a conduit housing that defines a pumping channel comprising an input aperture, sized and positioned to accept a flow of molten metal directed into it by the second impeller, and an output aperture in fluid communication with the input aperture of the cavitation cavity; and further defines an impeller cavity at least partially surrounding the periphery of the second impeller and in fluid communication with the pumping channel input aperture.

Also provided are methods for the production of metal matrix nanocomposites. In one embodiment, the method includes the steps of introducing nanoparticle agglomerates into a volume of molten metal contained within a cavity defined by a production chamber; mechanically mixing the nanoparticle agglomerates in the volume of molten metal, wherein the mixing reduces the size of the nanoparticle agglomerates; creating a cavitation zone within a sub-volume of the molten metal contained in a cavitation cell that is immersed in the larger volume of molten metal contained within the production chamber cavity; and dispersing the nanoparticles in the size-reduced nanoparticle agglomerates as individual nanoparticles in the molten metal by pumping the size-reduced nanoparticle agglomerates into the cavitation zone, wherein the dispersed individual nanoparticles pass out of the cavitation cell and back into the larger volume of molten metal.

Other principal features and advantages of the invention will become apparent to those skilled in the art upon review of the following drawings, the detailed description, and the appended claims.

BRIEF DESCRIPTION OF THE DRAWINGS

Illustrative embodiments of the invention will hereafter be described with reference to the accompanying drawings, wherein like numerals denote like elements.

DETAILED DESCRIPTION

Figure 1:
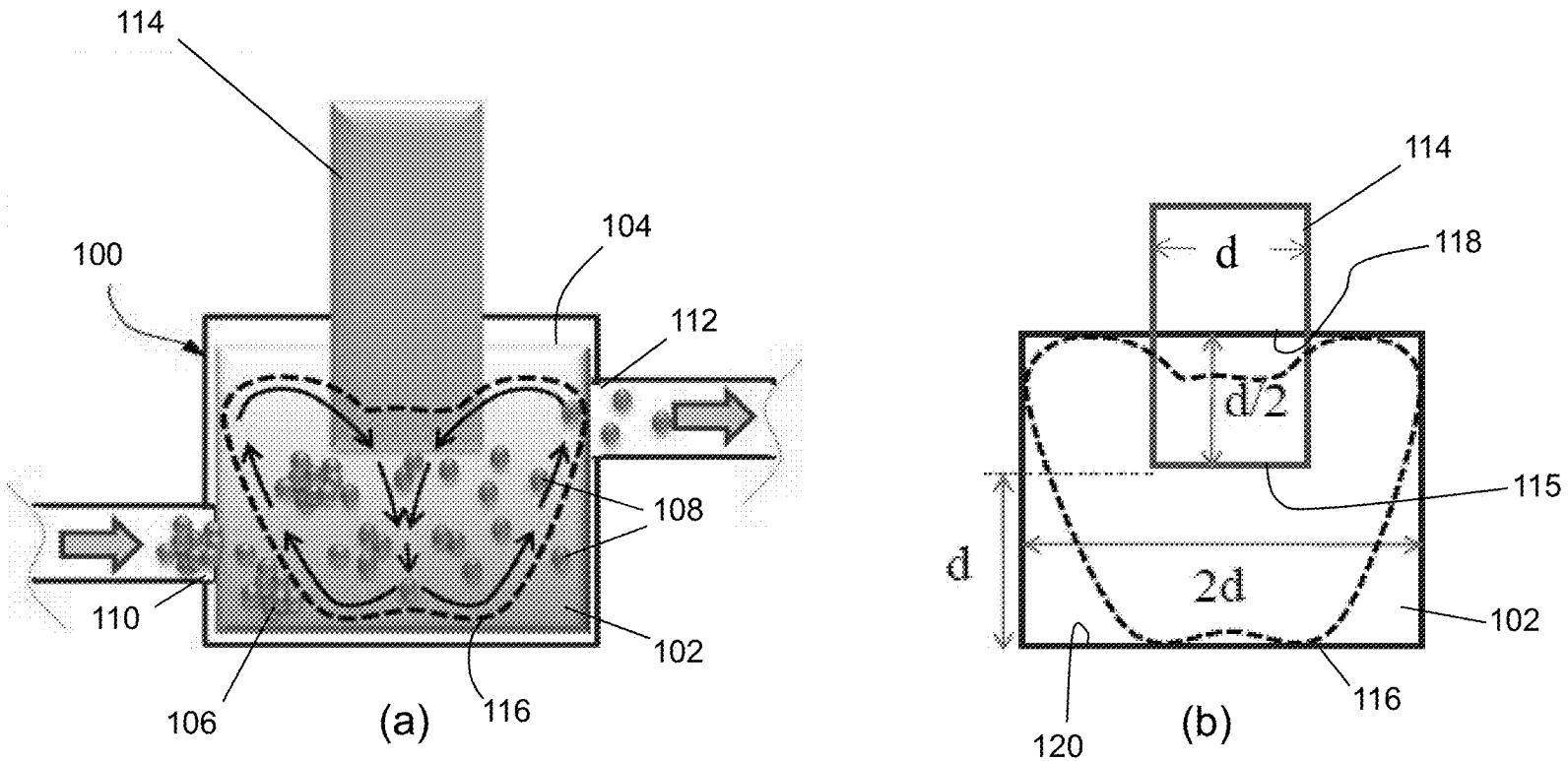
FIG. 1 is a schematic illustration of: (a) a cavitation cell containing a sub-volume of molten metal that conforms to the volume of the cavitation zone created by an ultrasonic probe, and (b) the relative dimensions of the cavitation cell and the cavitation zone.

Apparatus and methods for industrial-scale production of MMNCs are provided. The apparatus and methods enable scaled-up MMNC production in an industrial-scale production chamber without the need for a concomitant scale-up of the cavitation device or cavitation zone used to disperse the nanoparticles within the metal matrix. The methods can be used for the batch production of an MMNC in a volume of molten metal housed within the cavity of a production chamber. Within the volume of molten metal, a flow is created which continuously carries agglomerates of nanoparticles, which have been introduced into the molten metal, through a cavitation zone formed in a cavitation cell housed within the production chamber.

While in the volume of molten metal, nanoparticles are simultaneously being exposed to different stages of processing. Thus, one basic embodiment of the method includes the steps of introducing nanoparticle agglomerates into a volume of molten metal contained within a cavity defined by an industrial-scale production chamber; mechanically mixing the nanoparticle agglomerates in the volume of molten metal, wherein the mixing reduces the size of the nanoparticle agglomerates; creating a cavitation zone within the volume of molten metal; and dispersing the nanoparticles in the size-reduced nanoparticle agglomerates as individual nanoparticles in the molten metal by forcing the size-reduced nanoparticle agglomerates to pass through the cavitation zone.

The above-referenced mechanical mixing and nanoparticle dispersion steps take place simultaneously in a single production chamber by a combination of integrated processing systems that allow the nanoparticle agglomerates and individual, dispersed nanoparticles to circulate, and then re-circulate, through the mechanical mixing and cavitation stages in a continuous fashion during the production of the metal matrix nanocomposite. This is achieved by forming the cavitation zone in a cavitation cell that is at least partially immersed in the volume of molten metal. This design creates a sub-volume of the molten metal housed in the cavitation cell, the sub-volume being in fluid communication with the larger volume of molten metal around the cavitation cell. When the apparatus is in operation, nanoparticle agglomerates and dispersed, individual nanoparticles in the molten metal are able to re-circulate through the sub-volume of the cavitation zone in the cavitation cell and then back out into the larger, surrounding, volume molten metal until a desired level of nanoparticle dispersion is achieved. The sub-volume of molten-metal in the cavitation cell is typically much smaller than the larger volume of molten metal in which it is formed. For example, in some embodiments of the present methods, the volume ratio of the sub-volume of molten metal in cavitation cell to the total volume of molten metal in the production chamber cavity is no greater than about 1:2. This includes embodiments in which the ratio is no greater than about 1:3, embodiments in which the ratio is no greater than about 1:4 and embodiments in which the ratio is no greater than about 1:5.

Metal matrix nanocomposites produced by the present methods are composite materials composed of a bulk metal matrix and nanoscale particles (nanoparticles) that are dispersed within the matrix. Examples of metals that can be used in the bulk metal matrix include, but are not limited to, aluminum, magnesium, nickel, copper and their alloys. Materials from which the nanoparticles can be made include, but are not limited to, ceramics, oxides, nitrides, carbides and other carbon-based particles. Specific examples of the types of nanoparticles that may be dispersed in the metal matrices include aluminum oxide nanoparticles, aluminum nitride nanoparticles, carbon nanotubes, silicon carbide nanoparticles, silicon nitride nanoparticles, titanium carbide nanoparticles and tungsten carbide nanoparticles.

For the purposes of this disclosure, the term "nanoparticle" is used to refer to a particle having at least one dimension that is no greater than about 100 nm. This includes particles having at least one dimension that is no greater than about 50 nm and further includes particles having at least one dimension that is no greater than about 10 nm. Some nanoparticles may have only a single dimension that is no greater than about 100 nm. These include thin flakes. Other nanoparticles may have two dimensions (e.g., height and width) that are no greater than about 100 nm. These include nanotubes and nanowires. Still other nanoparticles may have no dimension that exceeds 100 nm. In some embodiments, it is desirable that the longest dimension of the nanoparticle is no greater than about 100 μm. This includes embodiments in which the longest dimension of the nanoparticle is no greater than about 10 μm and further includes embodiments in which the longest dimension of the nanoparticle is no greater than about 1 μm. As evidenced by the description above, the term "nanoparticle" is not intended to refer to particles of a particular shape. Thus, the nanoparticles can take on a variety of forms including, but not limited to, spherical or substantially spherical, elongated, cylindrical, or planar. In some cases the shapes will be irregular.

The concentration of nanoparticles in the MMNCs will depend, at least in part, on the desired properties (e.g., strength, wear-resistance, temperature stability, ductility and thermal and electrical conductivity) of the MMNC. By way of illustration only, the present apparatus and methods can be used to fabricate MMNCs having a nanoparticle concentration in the range from about 0.1 to 10 volume percent (vol. %). This includes embodiments in which the MMNCs have a nanoparticle concentration in the range from about 0.1 to 5 vol. % and further includes embodiments in which the MMNCs have a nanoparticle concentration in the range from about 1 to about 3 vol. %.

The present apparatus and methods can be designed to produce MMNCs on an industrial scale. For example, in some embodiments, the apparatus and methods can produce batches of MMNCs with batch sizes of at least 10 kg. This includes embodiments in which the MMNC are produced in batches of 100 kg, 500 kg, 1000 kg or greater. As described in greater detail, below, the present methods can be carried out in a volume of molten metal contained within the cavity of a single production chamber. Thus, if industrial-scale production is desired, the volume of molten metal can be large enough to produce the batch-sizes mentioned above. For example, in some embodiments the production chamber will be large enough to hold volumes of 3 liters or greater, 5 liters or greater, or even 10 liters or greater.

The industrial scale production of the MMNCs using the present apparatus can be carried out on time scales that are commercially practical. By way of illustration only, some embodiments of the present apparatus and methods can produce a quantity of at least 1 kg of MMNC, having the nanoparticle loadings recited herein, in a period of one hour or less. This includes embodiments in which at least 2 kg of the MMNC is produced in a period of one hour or less and further includes embodiments in which at least 5 kg of the MMNC is produced in a period of one hour or less.

An apparatus suitable for carrying out the present methods has three main, integrated systems—a nanoparticle feeding system, a mechanical mixing system and a cavitation system.

The nanoparticle feeding system is configured to introduce nanoparticles into a volume of molten metal contained within the cavity of a production chamber at a controlled, well-defined rate. The components comprising the nanoparticle feeding system include a nanoparticle source and a nanoparticle flow rate controller. The nanoparticle source is generally a container suitable for containing a quantity of nanoparticles before they are introduced into the molten metal. The flow rate of nanoparticles from the nanoparticle source into the molten metal, through a feeding system output port, is controlled by the nanoparticle flow rate controller. In a typical embodiment, the nanoparticle source opens into the nanoparticle flow rate controller, which is in communication with the feeding system output port. By "in communication with" it is meant that nanoparticle agglomerates from the nanoparticle flow rate controller are able to pass out of the flow rate controller and into the molten metal through the feeding system output port through one enclosed or partially enclosed pathway. The feeding system output port generally will be submerged in a volume of molten metal in the processing chamber when the apparatus is in operation. An auger is an example of a nanoparticle flow rate controller that can be used in the apparatus. However, other nanoparticle flow rate controllers, including known powder flow controllers can be employed.

The nanoparticles are introduced into the molten metal at a feed rate that allows the nanoparticles to agglomerate into relatively large agglomerates or 'clusters' as they are fed into the melt. It is desirable to introduce clusters having a size (diameter) of less than 1 mm, as larger clusters will float to the surface of the melt where they can react with the vapor above the melt. Thus, in some embodiments, the apparatus and methods are designed to introduce clusters with an average size in the range from about 300 to about 700 μm. Nanoparticle feed rates that are suitable for achieving a satisfactory introduction of nanoparticles into the melt include those in the range from about 1 to about 20 grams per minute (g/min) However, other feed rates can be used, including feed rates of 8 g/min or greater.

The mechanical mixing system is configured to force the nanoparticle clusters downward into the molten metal and to shear the nanoparticle clusters into nanoparticle agglomerates having a reduced size. The reduction in nanoparticle agglomerate size is advantageous because it prepares the nanoparticle agglomerates for introduction into the cavitation system and renders their dispersion more efficient. In some embodiments, the size-reduced nanoparticle agglomerates introduced into the cavitation system have an average particle size of 100 μm or less. For example, the average size of the nanoparticle agglomerates after mechanical mixing can be in the range from 10 μm to 100 μm.

The shear forces to which the nanoparticle clusters are exposed during the mechanical mixing step can be created by an impeller submerged in the volume of molten metal and disposed below the feeding system output port. In some embodiments the nanoparticle clusters are exposed to both an axial shear and a radial sheer during the mechanical mixing process. This can be accomplished by employing two or more impellers acting in concert to reduce the average nanoparticle agglomerate size and to create a flow channel in the molten metal that directs the nanoparticles exiting the feeding system downward and toward the cavitation system. The impeller or impellers can be designed to create turbulent flow in the molten metal, which aids agglomerate shear. As used herein, the term 'impeller' broadly refers to a rotating device, such as a rotor or blade, that is capable of forcing the molten metal in a desired direction.

The cavitation system is designed to disperse size-reduced nanoparticle agglomerates into individual nanoparticles in the molten metal. During cavitation, the nanoparticles are dispersed by a cavitation effect resulting from the bursting of bubbles created inside the agglomerates within the molten metal, which enhances nanoparticle wettability. The cavitation process is carried out in a cavitation zone formed in a sub-volume of the larger volume of molten metal held in the production chamber. The volume of the cavitation zone corresponds to the volume of molten metal in which the nanoparticle agglomerates are subjected to the cavitation action of the cavitation source. In the present methods, the cavitation zone is sized and positioned within the flow of molten metal such that the nanoparticle agglomerates carried by the flow of molten metal are forced to pass through the cavitation zone before returning to the larger volume of molten metal.

The components comprising the cavitation system include a cavitation cell that defines a cavitation cavity and a cavitation source configured to create a cavitation zone within the sub-volume of molten metal held within the cavitation cavity. The cavitation cell can be immersed in the volume of molten metal held within the production chamber and is open to the production chamber cavity via openings that allow fluid flow between the sub-volume of molten metal within the cavitation cavity and the larger volume of molten metal around the cavitation cell. One such opening is the cavitation cavity input port which is positioned to receive a flow of molten metal containing the size-reduced nanoparticle agglomerates from the mixing system. In one embodiment, the cavitation cavity input port is centered directly below the cavitation zone when the apparatus is in operation. In addition, the cavitation cell will have at least one cavitation cavity output port through which the molten metal having individual nanoparticles dispersed therein can exit the cavitation cavity after passing through the cavitation zone.

Cavitation sources suitable for use in the present methods and apparatus include, but are not limited to, ultrasonic probes, electromagnetic probe and cyclic high pressure cavitation sources.

The cavitation cell is desirably sized such that the sub-volume of molten metal held within the cavitation cavity conforms to the volume of the cavitation zone generated by the cavitation source. In addition, the cavitation cavity input and output ports are positioned such that the flow of molten metal containing the size-reduced nanoparticle agglomerates will pass through the cavitation zone before it can exit the cavitation cell. The sub-volume of molten metal held within the cavitation cavity can be said to 'conform to' the volume of the cavitation zone when the cavitation zone extends across the cavitation cavity between the input and output ports, thereby preventing any significant portion of the flow of molten metal entering the cavitation cavity from passing around (rather than through) the cavitation zone and out of the cavitation cavity. An illustration of a cavitation cell containing a sub-volume of molten metal that conforms to the volume of the cavitation zone created by an ultrasonic probe is shown in FIGS. 1(*a*) and (*b*). FIG. 1(*a*) is a schematic diagram showing a cross-sectional view of a cavitation cell 100 defining a cavitation cavity 102 filled with a molten metal 104 containing nanoparticle agglomerates 106 and individual dispersed nanoparticles 108. The cavitation cell includes a cavitation cavity input port 110 and a cavitation cavity output port 112. When the apparatus is in operation, a cavitation source, such as an ultrasonic probe 114, creates a cavitation zone 116 (shown in a dashed line) within the molten metal in the cavitation cavity. When the apparatus is in operation, nanoparticle agglomerates are forced through the cavitation zone where they are dispersed as individual nanoparticles in the molten metal as they circulate through the cavitation zone and, eventually, out through the cavitation cavity output port. The circulation paths in the cavitation zone are represented by arrows in the figure. Using this submerged cavitation cavity design, the nanoparticle dispersion process can be carried out in a continuous manner during the batch production of the MMNC in the production chamber.

FIG. 1(*b*) illustrates some example dimensions of the cavitation zone in the cavitation cavity. As shown in this figure, the cavitation zone 116 extends laterally and vertically across the cavitation cell such that nanoparticle agglomerates entering the cavitation cavity through the input port must traverse the cavitation zone before they can exit the cavitation cavity through the output port. In this figure, 'd' represents the diameter of the probe. Representative height and width dimensions (d and 2d) for the cavitation cell and for the probe immersion depth dimension (d/2) are shown in FIG. 1(*b*) for a cavitation system that uses an ultrasonic probe as a cavitation source. As shown in the figure, the distal end 115 of probe 114 extends into the cavitation cavity by a distance, "d/2", from an inner surface 118 of the cavity, and the distance between the distal end 115 of probe 114 and the opposing surface 120 is desirably no greater than about twice this distance (i.e., no greater than about "d"). Further, the width of the cavitation cavity is desirably no greater than about twice the distance between the distal end 115 of probe 114 and opposing surface 120 (i.e., the width of the cavitation cavity is desirably no greater than about "2d"). The term 'about' is used here to include dimensions that deviate slightly from the dimensions provided above, but that still ensure that the sub-volume of molten metal passing through the cavitation cavity must pass through (as opposed to around) the cavitation zone when the apparatus is in operation. Although the dimensions of the cavitation cavity can deviate somewhat from the dimensions shown in FIG. 1(*b*), it is generally desirable that the width of the cavitation cavity be no greater than about 2.5d.

A flow of molten metal containing size-reduced nanoparticle agglomerates can be delivered to the cavitation cavity by a pumping conduit which conducts the molten metal to the cavitation cell and forces (pumps) it into the cavitation cavity. As such, the pumping conduit will define a pumping channel that is sized and positioned to conduct a flow of molten metal containing dispersed, sized-reduced nanoparticle agglomerates from the mechanical mixing system toward the cavitation system. The pumping channel comprises an input aperture into which the flow of molten metal is directed by the mechanical mixing system and an output aperture from which the flow of molten metal exits into the cavitation cell. The flow of molten metal can be directed into the pumping channel by, for example, positioning the input aperture near an impeller of the mechanical mixing system, such that the rotation of the impeller directs the molten metal to flow into the input aperture. For example, when a mixing system comprising two or more impellers is employed, the pumping conduit can be configured to force molten metal to flow from the final impeller into the pumping channel.

The shapes and dimensions of the pumping channel, input aperture and output aperture are desirably designed to enhance the pumping action provided by the pumping conduit. For example, the pumping channel can have a cross sectional area which progressively decreases along at least a portion of its length from the input aperture toward the output aperture. In some embodiments, the pumping channel is continuously tapered from its input aperture to its output aperture. The output aperture is typically smaller than the input aperture and is sized to provide a desired, fixed molten metal flow rate into the cavitation cell. For example, the pumping conduit can be designed to provide molten metal flow rates into the cavitation cell in the range from about 0.5 m/s to about 2 m/s. By way of illustration only, in some embodiments the input aperture is a circular aperture having a diameter in the range from about d/4 to about ¾d, where d is the diameter of the probe in the cavitation cavity.

The pumping conduit can be integrated with an impeller of the mechanical mixing system via a pumping conduit housing that defines an impeller cavity (e.g., an arcuate cavity) that surrounds the periphery of the impeller and opens into the pumping channel.

Figure 2:
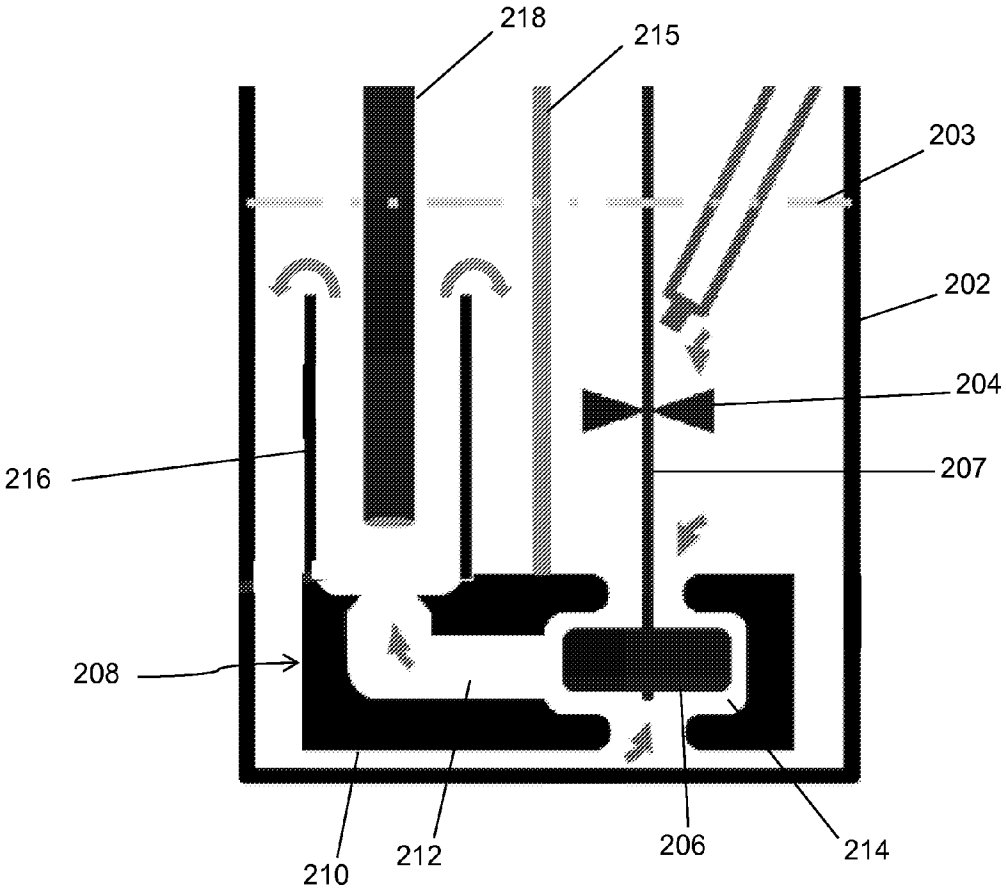
FIG. 2 is a schematic diagram showing a cross-sectional view of an embodiment of an apparatus in accordance with the present invention.

FIG. 2 is a schematic diagram showing a cross-sectional view of an embodiment of an apparatus in accordance with the present invention. A more detailed description of an apparatus of the type shown in this figure is described below in conjunction with FIGS. 4-10. The apparatus includes a production chamber 202 that defines a cavity. While in operation, a volume of molten metal 203 is held within the production chamber cavity. The apparatus further includes a mechanical mixing system comprising a first impeller 204 and a second impeller 206 mounted to a shaft 207. A pumping conduit 208 comprises a housing 210 that defines pumping channel 212 and impeller cavity 214. The conduit housing is mounted to and held in place by a shaft 215. Channel 212 opens into cavitation cell 216, into which the distal end of a sonication probe 218 is inserted. The arrows in the diagram indicate possible flow paths for the molten metal and for the nanoparticles dispersed within the molten metal as agglomerates or individual particles. These arrows illustrate the ability of the nanoparticles in the molten metal to circulate, and recirculate, between the mechanical mixing and cavitation phases of the MMNCs production process within a single volume of molten metal held in a single production chamber.

Figure 3:
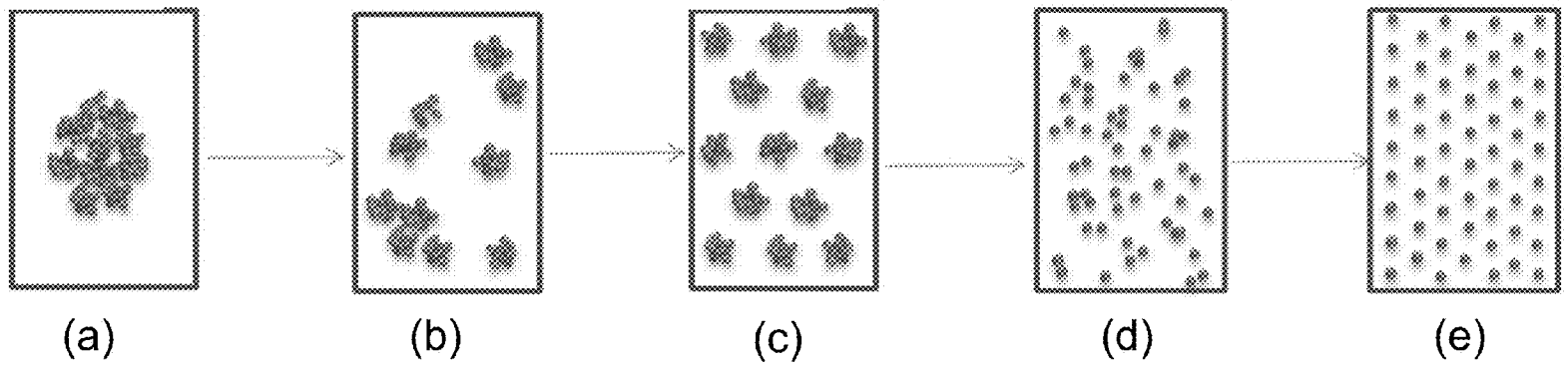
FIG. 3 is a schematic illustration of the stages of dissociation that the nanoparticles go through during MMNC production.

FIG. 3 is a schematic illustration of the stages of dissociation that the nanoparticles go through during MMNC production. As shown in panel (a), the nanoparticles typically enter the melt from the feeding system as large nanoparticle clusters. These clusters are broken up by the mechanical mixing system into smaller nanoparticle agglomerates (panel (b)) which become dispersed within the molten metal (panel (c)). In the cavitation zone, the nanoparticle agglomerates are broken up into individual nanoparticles, possibly with some residual small agglomerates, which become dispersed as throughout the melt to form the desired end-product (panel (d). An ideal homogeneous dispersion of individual nanoparticles in the molten metal is shown in panel (e). In the process illustrated in FIG. 3, nanoparticle clusters can continue to be fed into the melt until they are present in sufficient quantities to provide an MMNC with the desired nanoparticle loading. The mechanical mixing and cavitation process can continue until the desired level of nanoparticle dispersion has been achieved.

The materials selected for each component of the apparatus should be tailored to meet the particular demands placed on that component. For example, any components that are directly exposed to the molten melt should be selected such that they have a low dissolution rate in the melt and are resistant to the high melt temperatures. Such components include, for example, the inner surfaces of the production chamber which define the production cavity, impellers and impeller shafts, portions of the feeding system that contact the melt (e.g., a helical auger blade), and the pumping conduit housing and shaft. Materials that are suitable for these components include titanium, titanium alloys and titanium-based ceramics (e.g., TiC). The components can be constructed from these materials or coated with them. For example, components such as impeller shafts and blades can be constructed from a low carbon steel (e.g., H13 or H21) coated with TiC. In addition, it is advantageous if the components of the feeding system are resistant to erosion by the nanoparticles with which they come into contact. One example of a titanium alloy that is resistant to nanoparticle erosion and has a low dissolution rate in aluminum and magnesium alloys is Ti-6Al-4V. The materials that are in contact with the cavitation zone during the operation of the apparatus (e.g., the cavitation cell and portions of the cavitaion source) should also be composed of materials that are resistant to cavitation-induced corrosion. Such materials include niobium, titanium and their alloys. One example of a suitable niobium alloy is C-103 (9.6 wt. % Hf, 0.85 wt. % Ti, balance Nb).

In order to illustrate some features of the present apparatus in more detail, exemplary embodiments are described below, in conjunction with FIGS. 4-10.

Figure 4:
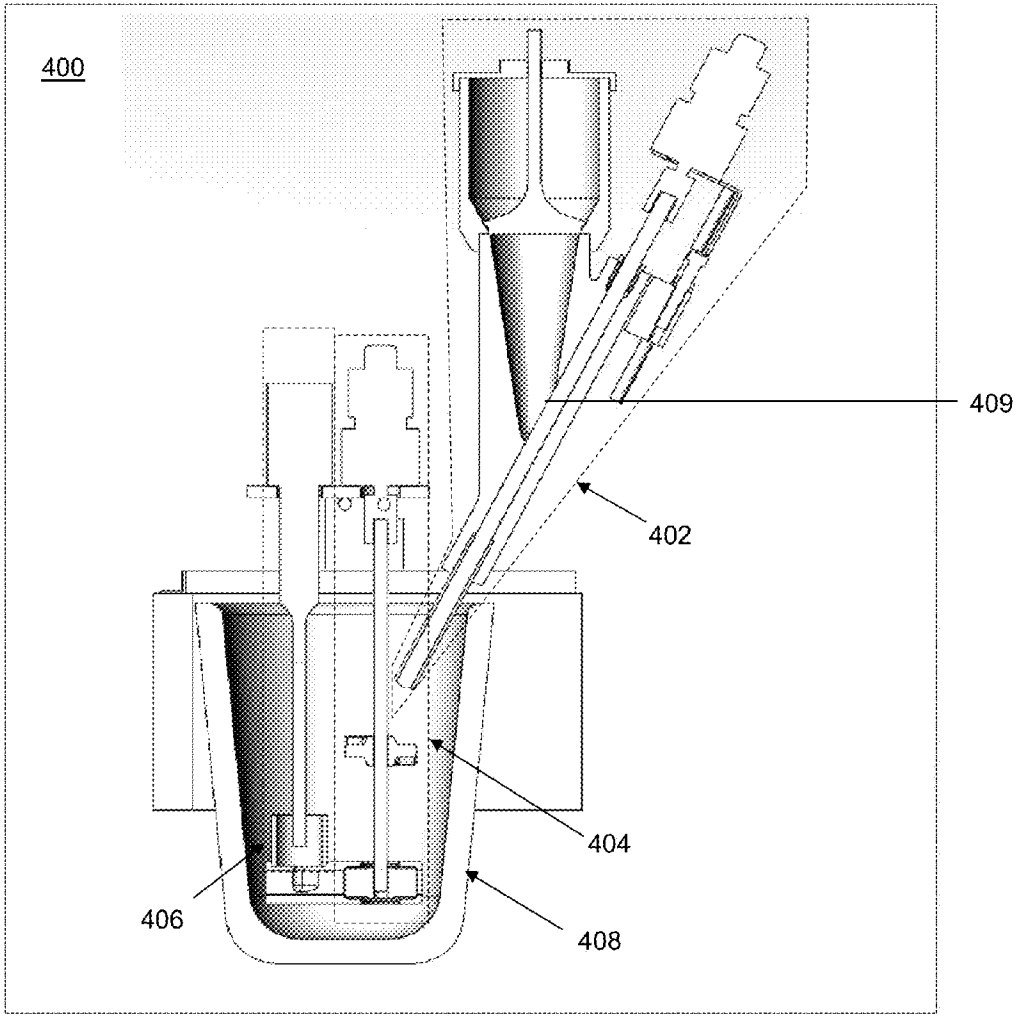
FIG. 4 is a more detailed cross-sectional view of the apparatus of FIG. 2.

With reference to FIG. 4 a diagram of a cross section of an MMNC production apparatus 400 is shown in accordance with an illustrative embodiment. MMNC production apparatus 400 is comprised of a feeding system 402, a mechanical mixing system 404, a cavitation system 406 and a production chamber 408. The collection of components comprising each system is outlined in a dashed line.

Figure 5:
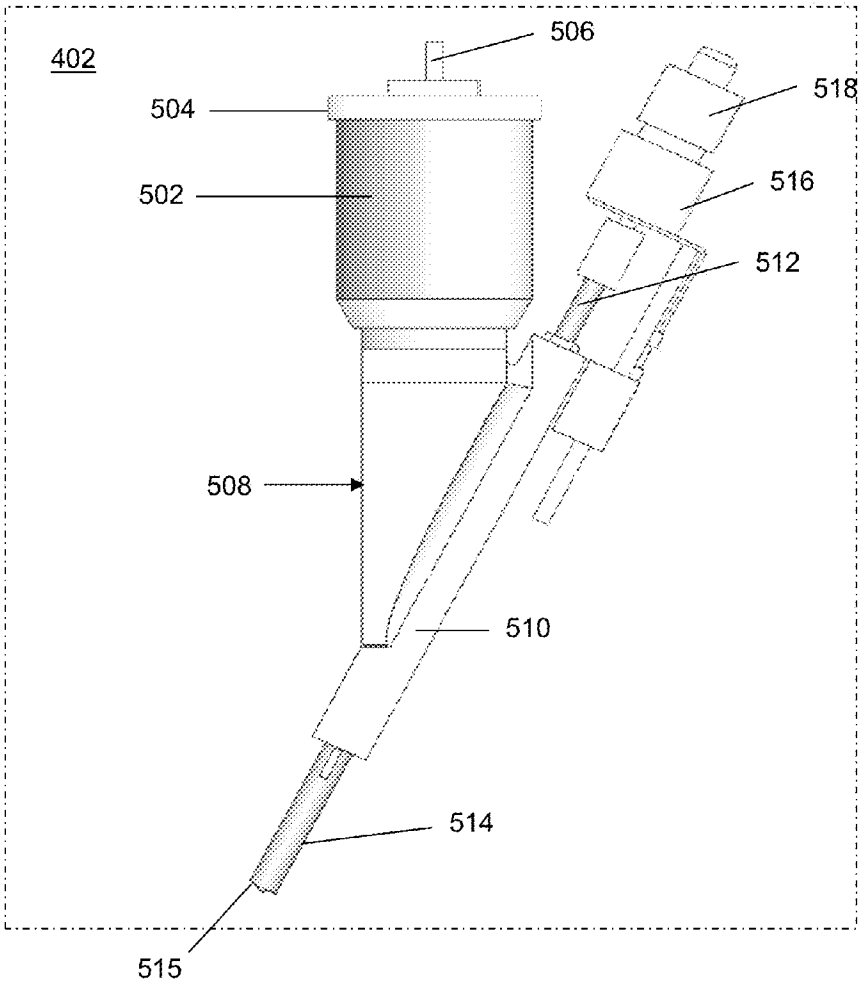
FIG. 5 is a perspective view of the feeding system of the apparatus of FIG. 4.

FIG. 5 shows a perspective view of the feeding system of the apparatus of FIG. 4. Feeding system 402 is configured to deposit nanoparticles into a molten metal at a specific rate to generate a mixture. Feeding system 402 comprises a nanoparticle source in the form of a canister 502, a lid 504 adapted to seal the canister, and a valve 506 adapted to force nanoparticles held with the canister out through a lower opening in the canister. The canister can also have a gas inlet port (not shown) to allow an inert gas to be introduced into the canister in order to maintain a positive pressure of non-reactive gas in the canister.

In the embodiment of FIG. 5, the nanoparticle flow rate controller, which controls the flow of nanoparticles from the nanoparticle source to the molten metal in the production chamber is provided in the form of an auger assembly. The auger assembly includes an auger housing 512 configured to receive a helical auger blade. Helical auger blade has a first end which is coupled to auger motor 516, and a second end which is enclosed by auger housing tip 514. Auger housing tip 514 is configured with a feeding system output port 515 at its end for depositing nanoparticles into a molten metal contained in the production chamber 408. The helical auger blade is designed for conveying nanoparticles when rotated. The rate of rotation of the auger blade is controlled by auger motor control 518. Auger motor 516 may be any variety of motors, such as an air-driven motor, suitable for rotating the auger blade at a rotation rate determined by auger motor control 518.

Figure 6:
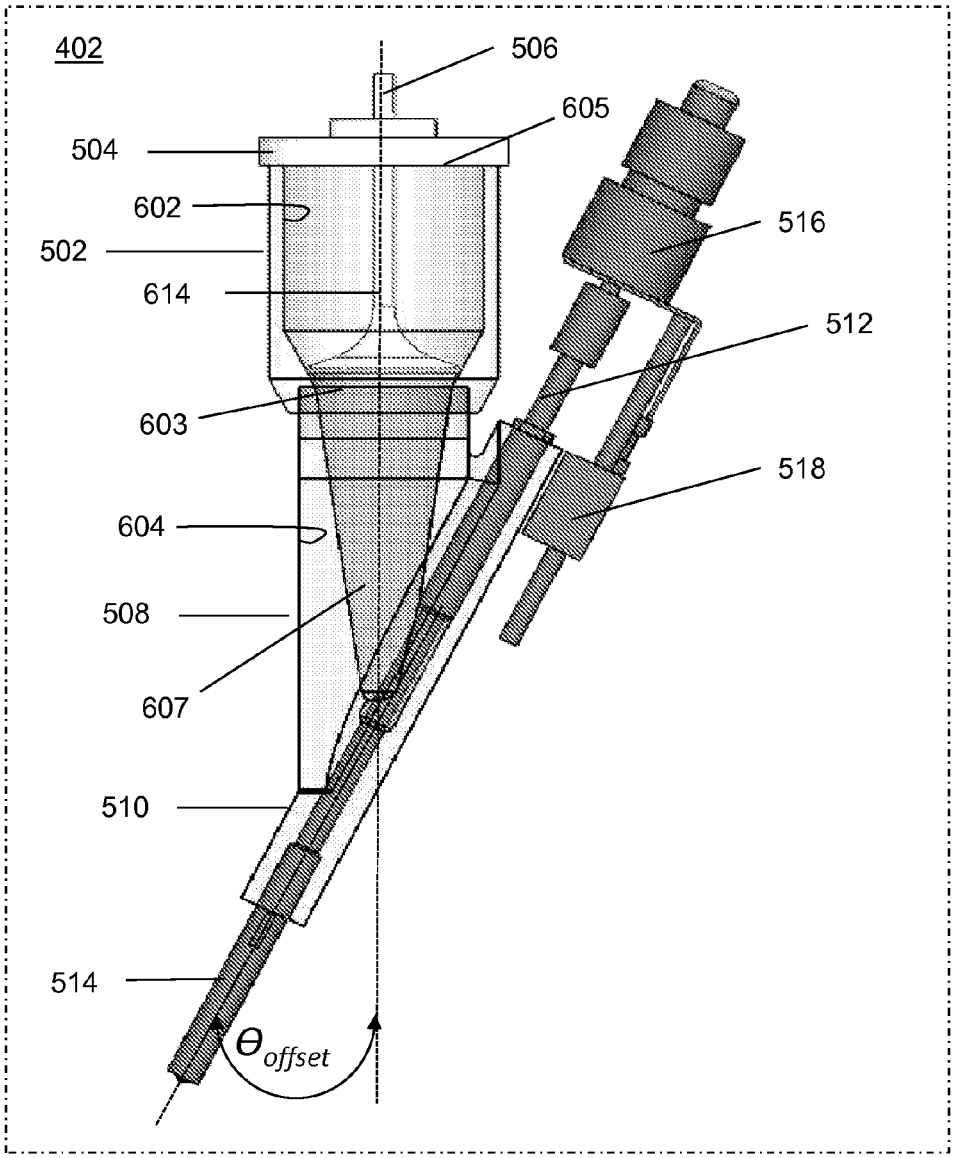
FIG. 6 is a cross-sectional view of the feeding system of FIG. 5.

As shown in FIGS. 5 and 6, the nanoparticle source and the nanoparticle flow rate controller can be combined into an integrated unit via a connecting joint 508. This interior surface of connecting joint 508 defines a channel 607 extending from bottom opening 603 of canister 502 to a side opening 409 in auger housing 512. The interior surface of connecting joint 508 further defines an auger sleeve 510 into which auger housing 512 can be inserted. For example, the interior surface of auger sleeve 510 may form an elongated cylinder configured to receive auger housing 512. This interior surface may be smooth or threaded. Connecting joint 508 joins the nanoparticle particle source and the nanoparticle feed rate controller into a monolithic unit, wherein nanoparticles can be conducted from the nanoparticle source to the auger blade which transports them into the molten metal.

Connecting joint 508 can be configured such that certain components of the feeding system (e.g., the motor, motor controller, and nanoparticle source) are not positioned directly above the molten metal contained in the production chamber when the apparatus is in operation. This is advantageous because it reduces the exposure of these components to the heat emanating from the molten metal. For example, in the embodiment depicted in FIG. 6, auger housing 512 is positioned at an angle $\theta_{offset}$ relative to the vertical axis 506 through canister 502.

FIG. 6 depicts a cross-sectional view of feeding system 402, including interior surface 602 of canister 502, as well as the interior surface 604 connecting joint 508, and a valve cross-section 614.

Canister interior surface 602 may be a smooth surface that is generally cylindrical in shape, however other interior surface geometries are possible. The internal cavity formed by canister interior surface 602 may be narrower at the bottom than at the top. For example, the circumference of the opening 603 formed at the bottom of canister interior surface 602 may be smaller than the circumference of the opening 605 formed at the top of canister interior surface 602 to facilitate moving materials from canister 502 into connecting joint 508.

Figure 7:
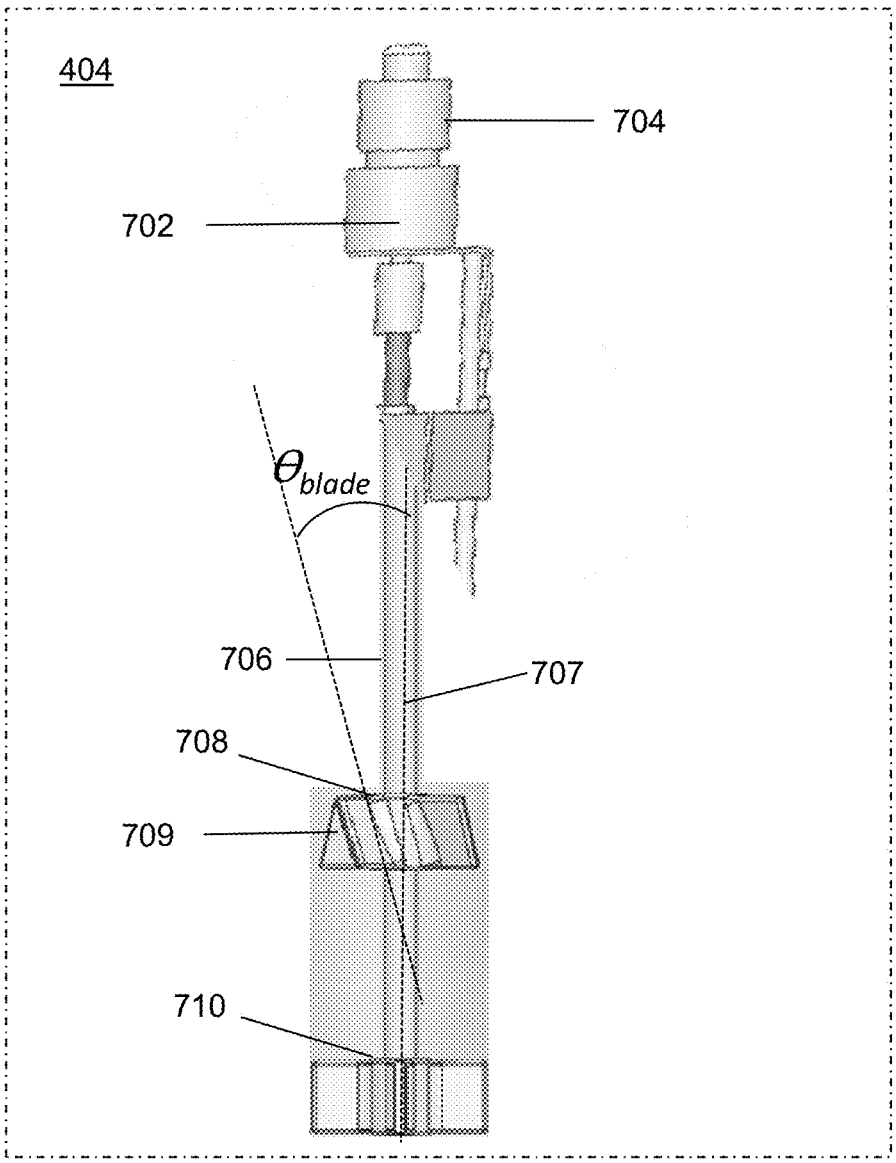
FIG. 7 is a perspective view of the mechanical mixing system of the apparatus of FIG. 4.

FIG. 7 depicts a perspective view of mixing system 404 of MMNC production system 400. Mixing system 404 comprises an impeller motor 702, an impeller motor control 704, an impeller shaft 706, an axial shear impeller 708 and a radial shear impeller 710 mounted to shaft 706 and disposed below axial shear impeller 708. The rotation of shaft 706 is controlled by impeller motor control 704. For example, impeller motor 702 may be an air-driven motor. Impeller motor 702 may be any of a variety of motors suitable for rotating shaft 706.

Impeller motor 702 is coupled to a first end of shaft 706 and radial shear impeller 710 is mounted on the second end of shaft 706. Axial shear impeller 708 is mounted on shaft 706 between shaft 706 first end and shaft 706 second end. The forward faces of the blades 709 of axial shear impeller 708 are angled downward at an angle $\theta_{blade}$, relative to the longitudinal axis 707 of shaft 706 (i.e., they are forward-pitched), to induce turbulent flow within the molten metal matrix and to induce a flow of molten metal toward radial shear impeller 710. Axial shear impeller 708 can create turbulent flow within the molten metal held in canister 502, resulting in shearing stresses which act upon the nanoparticle agglomerates, breaking them up and reducing their size. A flow of the resulting mixture of molten metal and randomly-distributed, size-reduced nanoparticle agglomerates is directed toward radial shear impeller 710, traveling substantially in the direction of the longitudinal axis 707 of shaft 706. This flow can be accelerated by radial shear impeller 710, which also forces the flow toward the entrance of a cavitation cell. The blades of radial shear impeller 710 in this embodiment of the apparatus are not pitched. The flow of molten metal and size-reduced nanoparticle agglomerates directed by radial shear impeller 710 travels substantially in a direction of about 90° with respect to longitudinal axis 707. It is advantageous to position the axial shear impeller and the radial shear impeller sufficiently close together along the impeller shaft that the two impellers create an integrated and continuous flow pattern, rather that two spatially separated, independent flow zones.

Figure 8:
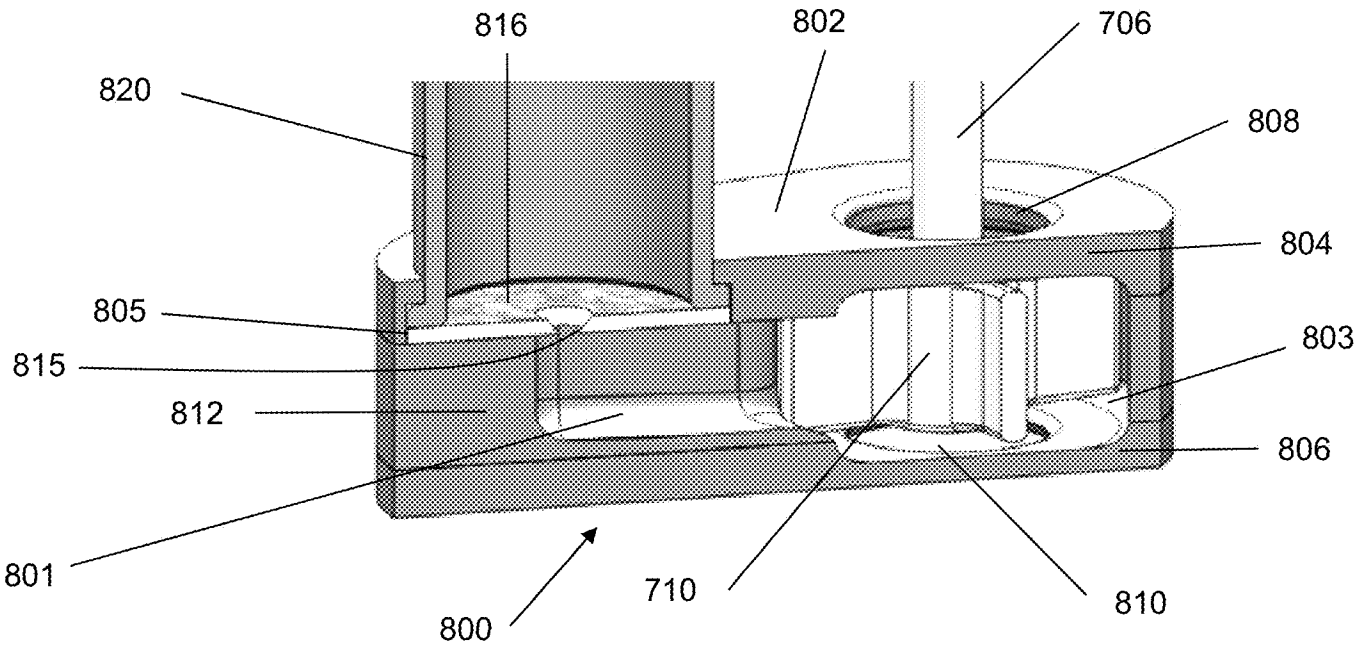
FIG. 8 is a cross-sectional view of the pumping conduit of the apparatus of FIG. 4.

FIG. 8 shows a cross-sectional view of a pumping conduit 800 that funnels the flow of molten metal and size-reduced nanoparticle agglomerates from radial shear impeller 710 to the cavitation cell 820. As depicted in FIG. 5, the mixture of molten metal and size-reduced nanoparticle agglomerates are conducted into cavitation cell 820 through a pumping channel 801 defined by a pumping conduit housing 802. As shown in FIG. 8, pumping conduit housing 802 can also define an arcuate impeller cavity 803 in which radial shear impeller 710 is partially enclosed. Pumping conduit housing 802 may be constructed of a top plate 804 and a bottom plate 806 which define first 808 and second 810 input apertures, which allow molten metal to enter impeller cavity 803 from two directions. Pumping conduit housing 802 also comprises a center plate 812 positioned between top plate 804 and bottom plate 806 which defines the interior surface geometry of pumping conduit 800. An output aperture plate 816 is seated in a opening 805 in top plate 804. The bottom surface of plate 816 defines an output aperture 815 for pumping channel 801.

Figure 9:
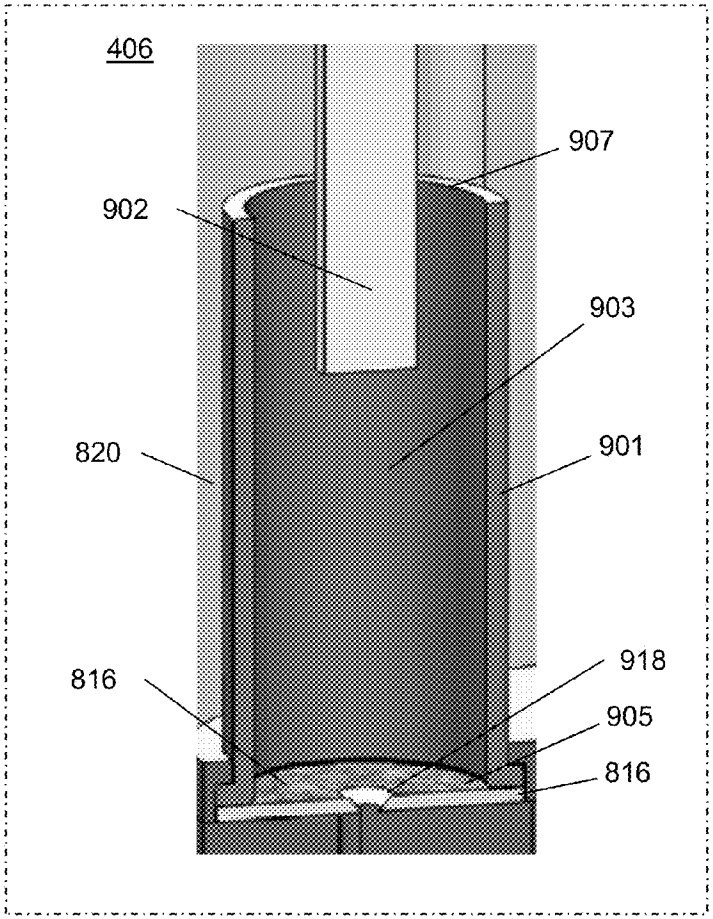
FIG. 9 is a cross-sectional view of the cavitation system of the apparatus of FIG. 4.

FIG. 9 depicts a cross-sectional view of cavitation cell 820 of metal matrix nanocomposite production system 400. Cavitation cell 820 comprises the upper surface of plate 816, cavitation cell housing 901 and ultrasonic probe 902. Cavitation cell housing 901 defines an internal cavitation cavity 903 in which probe 902 creates a cavitation zone when the apparatus is in operation. The upper surface 905 of plate 816 defines an input aperture 918 through which molten metal enters the cavitation cavity from the pumping channel. In the embodiment of FIG. 9, the hole through plate 816 that defines both the output aperture of the pumping channel and the input aperture of the cavitation cavity is beveled in order to help force the flow of molten metal into the cavitation cavity. Housing 901 defines an output aperture 907 through which molten metal exits the cavitation cavity. Probe 902 and cavity 903 are sized and positioned such that the cavitation zone extends across the diameter of the cavitation cavity when the apparatus is in operation. Input aperture 918 and output aperture 907 are positioned such that nanoparticle agglomerates entering cavity 903 must pass through the cavitation zone before the exit through output aperture 907.

As used herein, the term "mount" includes join, unite, connect, associate, insert, hang, hold, affix, attach, fasten, bind, paste, secure, bolt, screw, rivet, solder, weld, glue, form over, layer, and other like terms. The phrases "mounted on" and "mounted to" include any interior or exterior portion of the element referenced.

What is claimed is:

1. An apparatus for the production of metal matrix nanocomposites comprising:

(a) a production chamber defining a cavity;

(b) a nanoparticle feeding system comprising:

a nanoparticle source in communication with the production chamber cavity through a feeding system output port, and a nanoparticle flow rate controller configured to control the flow rate of nanoparticles from the nanoparticle source to the feeding system output port;

(c) a mixing system comprising:

a first impeller disposed within the production chamber cavity and configured to apply an axial shear force to nanoparticle agglomerates entering a molten metal held in the production chamber cavity through the feeding system output port, and to force the nanoparticle agglomerates downward into the molten metal, and a second impeller disposed within the production chamber and configured to apply a radial shear force to nanoparticle agglomerates forced downward into a molten metal held in the production chamber by the first impeller;

(d) a cavitation system comprising:

a cavitation cell disposed within the production chamber cavity and defining a cavitation cavity having an input aperture and an output aperture, wherein the cavitation cell is positioned within the production chamber cavity such that a sub-volume of molten metal held within the cavitation cavity could flow out through the output aperture and back into a larger volume of molten metal held in the production chamber cavity, and a cavitation source configured to create a cavitation zone within a molten metal held in the cavitation cavity; and (e) a pumping conduit configured to conduct a flow of molten metal from the second impeller into the cavitation cavity through the cavitation cavity input aperture.

2. The apparatus of claim 1, wherein the production chamber cavity has an internal volume that is large enough to hold at least three liters of molten metal.

3. The apparatus of claim 1, wherein the nanoparticle flow rate controller comprises an auger assembly comprising an auger housing that defines an opening in communication with the nanoparticle source and an auger blade received within the auger housing and configured to transport nanoparticles from the nanoparticle source to the feeding system output port when the auger blade is rotated.

4. The apparatus of claim 1, wherein the cavitation cavity input aperture is centered directly below the cavitation source in the cavitation cavity and the cavitation cavity output aperture is disposed opposite the cavitation cavity input aperture, and further wherein the cavitation source extends into the cavitation cavity through the cavitation cavity output aperture.

5. The apparatus of claim 1, wherein the cavitation source is an ultrasonic probe having a distal end that extends into the cavitation cavity.

6. The apparatus of claim 5, wherein the distance between the distal end of the ultrasonic probe and a surface of the cavitation cavity disposed opposite the distal end of the ultrasonic probe is no greater than about a diameter of the ultrasonic probe, and further wherein the cavitation cavity has a width that is no greater than about twice the diameter of the ultrasonic probe.

7. The apparatus of claim 1, wherein the pumping conduit comprising a conduit housing that defines:

(i) a pumping channel comprising an input aperture, sized and positioned to accept a flow of molten metal directed into it by the second impeller, and an output aperture in fluid communication with the input aperture of the cavitation cavity; and (ii) an impeller cavity at least partially surrounding the periphery of the second impeller and in fluid communication with the pumping channel input aperture.

8. The apparatus of claim 7, wherein the cavitation cavity input aperture is centered directly below the cavitation source in the cavitation cavity and the cavitation cavity output aperture is disposed opposite the cavitation cavity input aperture; further wherein the cavitation source is an ultrasonic probe having a distal end which extends into the cavitation cavity through the cavitation cavity output aperture; and still further wherein the first impeller is mounted to an impeller shaft and comprises at least one forward-pitched impeller blade.

9. The apparatus of claim 1, wherein the first impeller is mounted to an impeller shaft and comprises at least one impeller blade, wherein the at least one impeller blade is a forward-pitch impeller blade.

10. A method of producing a metal matrix nanocomposite using an apparatus for the production of metal matrix nanocomposites comprising:

(a) a production chamber defining a cavity;

(b) a nanoparticle feeding system comprising:

a nanoparticle source in communication with the production chamber cavity through a feeding system output port, and a nanoparticle flow rate controller configured to control the flow rate of nanoparticles from the nanoparticle source to the feeding system output port;

(c) a mixing system comprising:

a first impeller disposed within the production chamber cavity and configured to apply an axial shear force to nanoparticle agglomerates entering a molten metal held in the production chamber cavity through the feeding system output port, and to force the nanoparticle agglomerates downward into the molten metal, and a second impeller disposed within the production chamber and configured to apply a radial shear force to nanoparticle agglomerates forced downward into a molten metal held in the production chamber by the first impeller;

(d) a cavitation system comprising:

a cavitation cell disposed within the production chamber cavity and defining a cavitation cavity having an input aperture and an output aperture, wherein the cavitation cell is positioned within the production chamber cavity such that a sub-volume of molten metal held within the cavitation cavity could flow out through the output aperture and back into a larger volume of molten metal held in the production chamber cavity, and a cavitation source configured to create a cavitation zone within a molten metal held in the cavitation cavity; and (e) a pumping conduit configured to conduct a flow of molten metal from the second impeller into the cavitation cavity through the cavitation cavity input aperture, the method comprising introducing nanoparticles in the form of nanoparticle agglomerates into a molten metal contained in the production chamber cavity using the nanoparticle feeding system; mechanically mixing the nanoparticle agglomerates with the molten metal using the mechanical mixing system to provide size-reduced nanoparticle agglomerates; pumping the size-reduced nanoparticle agglomerates in the molten metal into the cavitation cavity; and forcing the size-reduced nanoparticle agglomerates through a cavitation zone in the cavitation cavity.

* * * * *